United States Patent [19]

Echavarrio

[11] Patent Number: 4,641,593

[45] Date of Patent: Feb. 10, 1987

[54] ZIGZAG AND TRANSPORT DEVICE FOR SEWING MACHINES

[76] Inventor: Fernando C. Echavarrio, Pº de San Andres, 8 Eibar (Guipuzcoa), Spain

[21] Appl. No.: 787,436

[22] Filed: Oct. 15, 1985

[51] Int. Cl.[4] ..... D05B 3/02

[52] U.S. Cl. ..... 112/443; 112/464

[58] Field of Search ..... 112/443, 459, 462, 464, 112/315

[56] References Cited

U.S. PATENT DOCUMENTS

| | | | |
|---|---|---|---|
| 3,011,462 | 12/1961 | Ritter et al. | 112/315 |
| 4,393,794 | 7/1983 | Eguchi et al. | 112/443 |
| 4,398,481 | 8/1983 | Gustavsson | 112/443 |
| 4,441,441 | 4/1984 | Bianchi | 112/443 X |
| 4,501,213 | 2/1985 | Meier | 112/443 X |

*Primary Examiner*—Werner H. Schroeder
*Assistant Examiner*—Andrew M. Falik
*Attorney, Agent, or Firm*—Bucknam and Archer

[57] ABSTRACT

A sewing machine provides zigzag and feed drive features through operation of independent synchronized stepper motors. A first stepper motor imparts reciprocating motion to a first rack piece which is hingedly connected to a middle piece and a lever. The lever is connected to a needle supporting piece which imparts zigzag motion to a needle. A second stepper motor through a second rack piece imparts oscillating motion to a connecting rod. Shifting motion in a feeding device is provided by an axle which is powered by the oscillating connecting rod.

3 Claims, 3 Drawing Figures

ZIGZAG AND TRANSPORT DEVICE FOR SEWING MACHINES

BACKGROUND OF THE INVENTION

The present invention generally relates to a sewing machine which is provided with zigzag needle and material feed drive features. More specifically the invention is directed to a zigzag motion of a needle which is accomplished by means of two synchronized stepper motors.

Stepper motors have the capability of providing accuracy and control in motor applications and have been increasingly employed in diverse engineering fields. Sewing machines have been marketed which employ a stepper motor for performing a specific operation.

SUMMARY OF THE INVENTION

The object of the present invention is the use of two stepper motors by means of which adequate zigzag needle movement is provided. According to the invention a driving shaft of a first stepper motor drives a rack which at one end is coupled with the end of a lever cranked at some points along its length and pivotable in relation to the machine chassis. The lever at its opposite end is fastened in an articulated manner to the supporting part of the needle's bar. The above supporting piece is pivotable at its upper end.

A second stepper motor connects its driving shaft with a rack which, through an intermediate piece, shifts the position of a connecting rod which by its upper side is held in permanent contact with an eccentric by the action of a tension spring. The eccentric is driven by a shaft of the main motor of the machine. The connecting rod is interlocked at its lowest end to an axle to impart forward and backward motion to a conveying means of the machine. The lowest end of the connecting rod moves within an area which has larger or smaller size depending on the position of the rod which in turn translates itself into a larger or smaller displacement of the conveyor means.

Controlled actuation of both stepper motors is performed through electronic media and preferably by means of a microprocessor.

The detailed description of the invention which follows refers to the enclosed drawings which show a preferred embodiment of the invention.

DESCRIPTION OF THE PREFERRED EMBODIMENT

Figure 1:
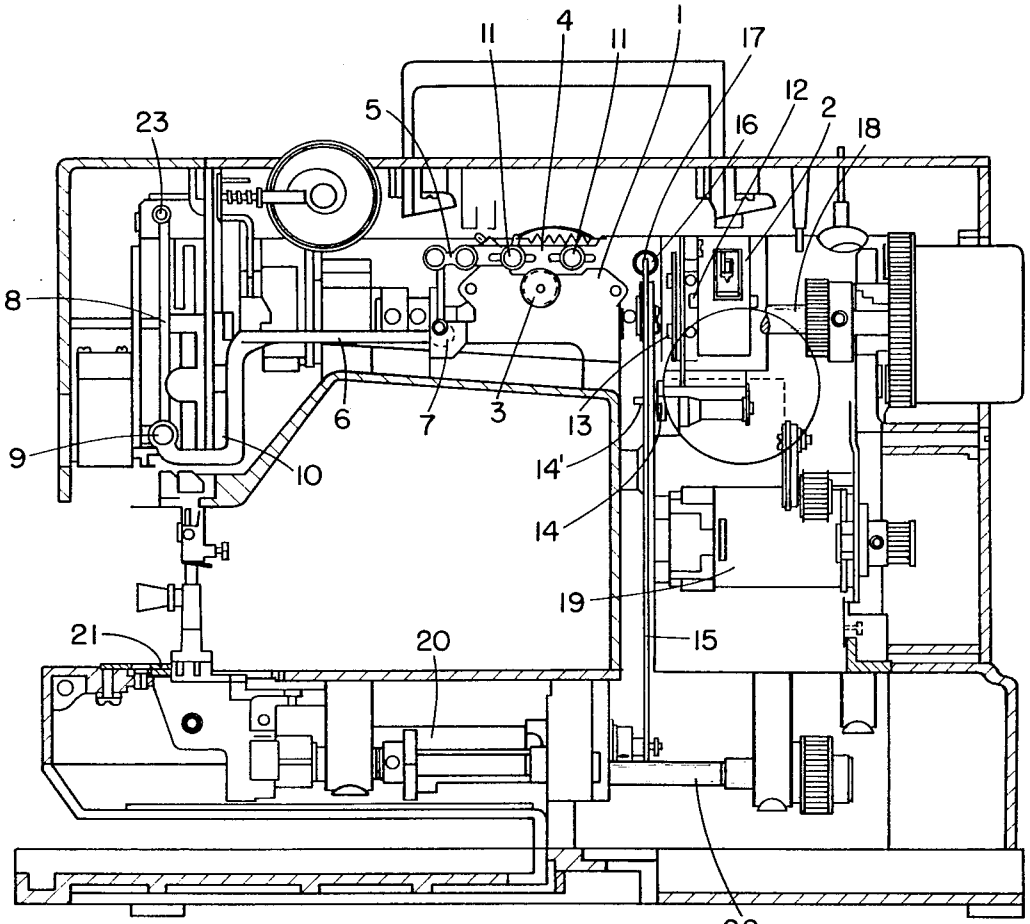
FIG. 1 shows an elevation view, in section, of a sewing machine which features the developments which are the subject of the invention.

Referring firstly to FIG. 1, there is shown an elevational view of a longitudinal section made by a sewing machine which features the developments which are the subject of this invention.

The sewing machine includes a first stepper motor 1 and a second stepper motor 2. Driving shaft 3 of motor 1 displaces a rack piece 4 hinged at one end with a middle piece 5, which on its opposite end is likewise hinged with a lever 6 cranked at different points along its length. The lever 6 is pivotably fastened to the machine chassis by a connecting piece 7 and it has a free end clamped, also pivotably, by means of a screw 9 to a supporting piece 8 of a needle bar 10. Rack piece 4 is driven in a reciprocating manner by stubs 11 seated in openings in the rack piece.

The second motor 2 has its driving shaft 12 connected to a rack piece 13 through a middle piece 14 to allow position shifting of connecting rod 15. An upper end of the connecting rod 15 is urged by the traction of a spring 16 permanently against an eccentric 17 linked with a shaft 18 which is driven by the main motor 19 of the machine by means of a belt or another suitable type of transmission.

The connecting rod 15 is interlocked at its lowest end to a horizontal axle 20 by virtue of which the oscillating movement of said connecting rod 15 results in a forward and backward motion of the feeding device of the machine. This oscillating movement of connecting rod 15 takes place in the area around shaft 14' of the middle piece 14.

The shaft 22 is driven by the main motor 19, preferably by means of a belt, to provide a lifting and lowering motion to feed device 21.

Figure 2:
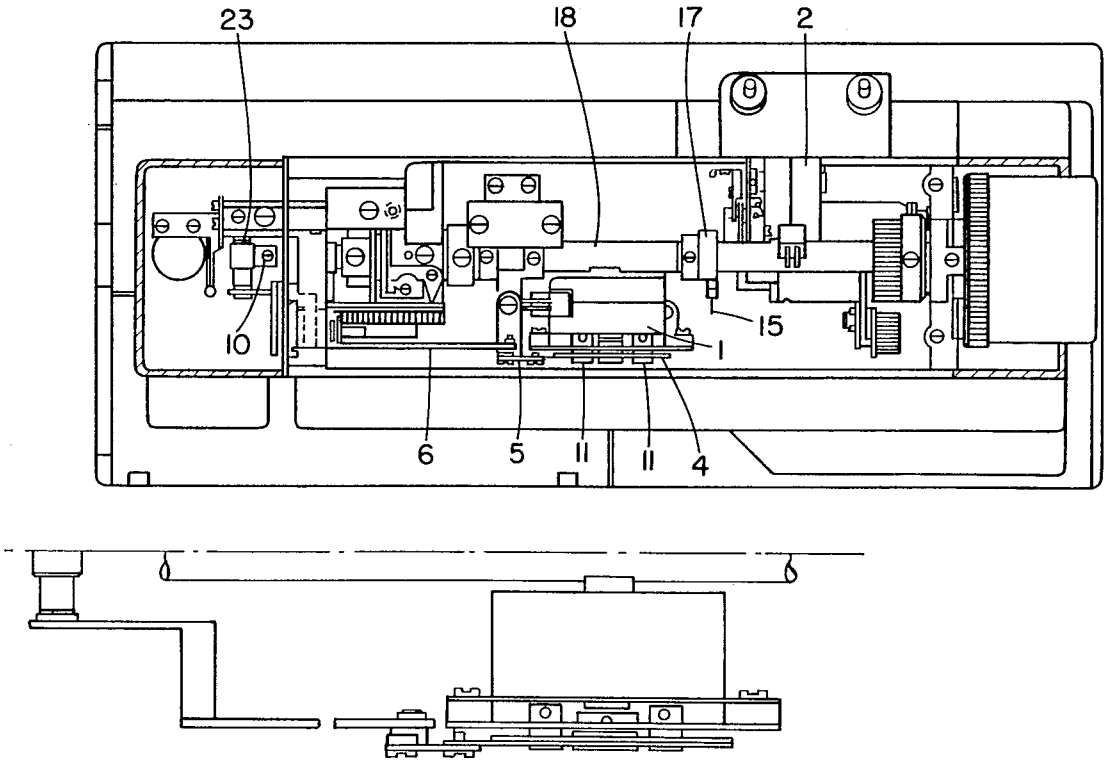
FIG. 2 shows a horizontal cross-sectional view of the sewing machine shown in FIG. 1.

FIG. 2 shows a horizontal cross-sectional view of the machine of FIG. 1. In the Figure is illustrated the connecting rod 15 which is urged by spring 16 against eccentric 17 fastened to a shaft 18. The figure also shows the relative position of stepper motors 1 and 2 and their associated elements. It also shows short axle 23 relative to which needle bar 10 can pivot.

Figure 3:
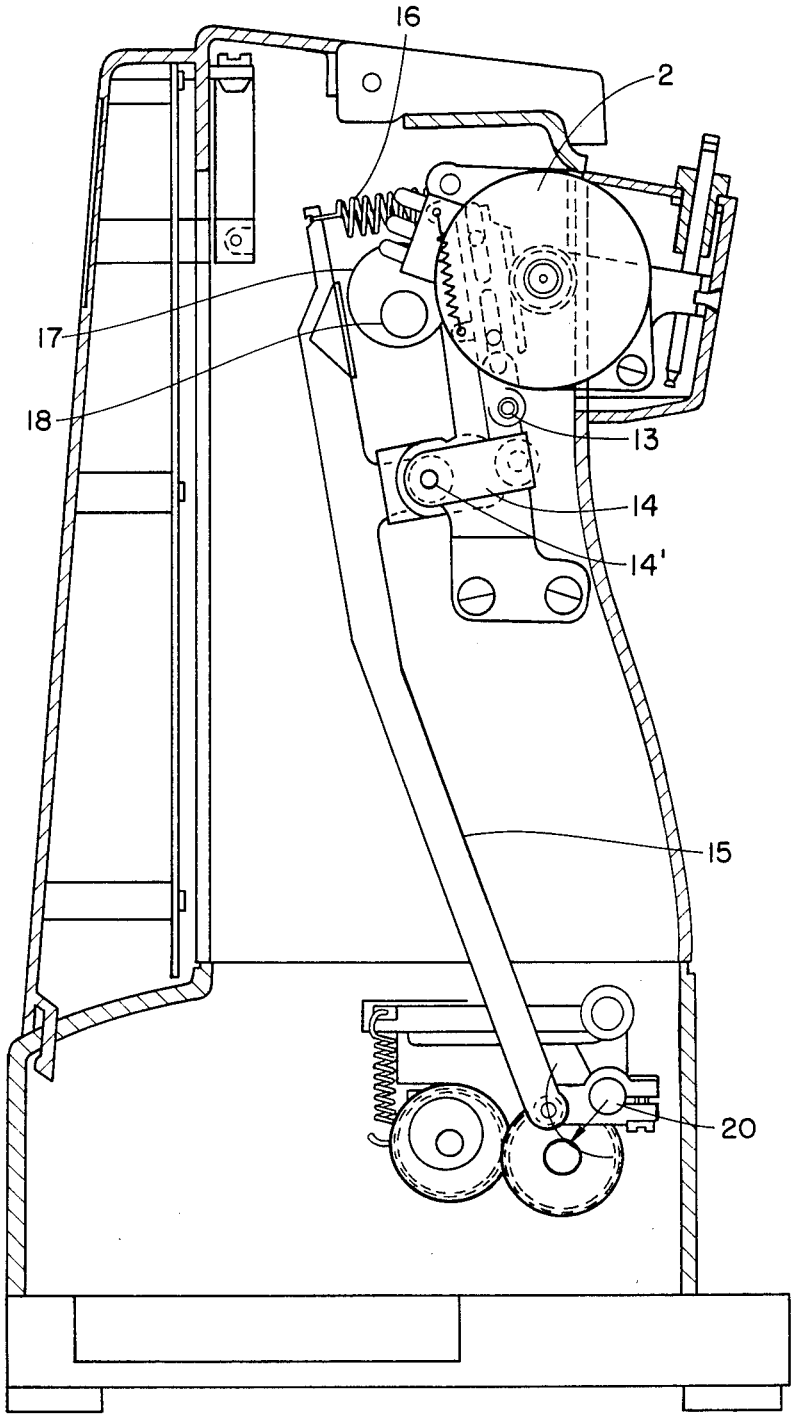
FIG. 3 illustrates an elevation view of a cross section made at the sewing machine of FIG. 1 in the proximity of the position of the stepper motor which drives the conveyor mechanism of the machine.

In FIG. 3 it can be seen that the rack piece 13 is driven by the axle of the motor 2 and shiftable by it, as well as fastened at its lower side to the end of a middle piece 14 whose opposite end is hinged to connecting rod 15. Likewise it may be seen that the spring 16 exerts traction on the upper end of said connecting rod 15 to keep it permanently resting on the peripheric surface of eccentric 17. On the lower side the connecting rod 15 is connected to shaft 20.

As stated above, the operation of both motors 1 and 2 is independent as stated above and is controlled by electronic means. These electronic means can be chosen so as to be able to be programmed for the operation of both motors 1 and 2 according to desired results.

As stated above, motor 1 is used to provide a zigzag motion to the machine needle. Therefore the stepper motor controlled by the electronic means provides to rack 4 a reciprocating movement which is transmitted through the middle piece 5 to the end related to cranked lever 6, whose opposite end is hinged through screw 9 to support 8 of the needle bar 10. In this way the reciprocating motion of rack 4 becomes the zigzag movement desired for the needle.

The embodiment has the advantage that by means of a minor number of simple elements it is possible to provide the zigzag effect of the needle. It is to be understood that a larger or smaller amplitude of the reciprocating motion of rack 4 translates itself respectively into a larger or smaller width of zigzag; then if the travel of rack 4 is constantly regulated a predetermined shape of zigzag can be obtained.

The stepper motor 2 is in charge of regulating the shifting limits of the travelling device of the machine. In fact the above device is subject to the combination of two movements, i.e., one of lifting-lowering and the other of forward-back motion. The lifting-lowering movement is provided in a known manner by shaft 22 driven by the main motor of the machine as stated above. The forward-back motion is provided by shaft 20 actuating feeding device 21 driven in turn by connecting rod 15.

The movement of the shaft 20 is of larger or smaller amplitude according to the position adopted by the rack piece 13. As shown in FIGS. 1 and 3, the motion of shaft 18 moves eccentric 17 communicating a reciprocating motion to the upper end of the connecting rod 15 which pivots in relation to axle 14' which is connected to middle piece 14. The lower end of the connecting rod moves within an area centered at shaft 14' the size of which depends on the distance between the pivoting shaft 14' and the contact point between the connecting rod 15 and eccentric 17. As shown in FIG. 3, the area in which the lowest end of the connecting rod 15 travels (and also axle 20) has a definite size which translates itself into a definite shifting of the carrying device. The actuation of motor 2 changes the position of rack 13. Consequently the connecting rod can be shifted altering the distance between shaft 14' of pivoting and the contact point of connecting rod 15 and eccentric 17. This occurs because shaft 14' moves with the movement of rack 13, and thus its relative position with respect to the aforementioned contact point changes. The result is a variation of the size of the area in which the lower end of connecting rod 15 and axle 20 move.

The main advantage of the invention is the use of a small number of simple components in order to impart forward-back motion to the feeding device. It should be understood that when operating the stepper motor 2 either by programming or by any other means it is possible to regulate constantly the shifting of the feeding device, if desired.

The combined regulation of both stepper motors 1 and 2 by means of programming or by any other proper means permits use of the sewing machine to sew figures or drawings of any kind on fabrics.

The invention has been described according to a preferred embodiment of same. It must be realized, notwithstanding, that within its scope might be introduced multiple variations of detail likewise protected which could effect its shape, size or manufacturing materials of assembly or its parts without altering at all the object of the invention.

I claim:

1. A sewing machine of the type having a chassis, a main motor, and material drive features, wherein the improvement comprises:

a needle bar having a supporting piece attached thereto, a first rack piece mounted on the chassis for reciprocating movement, said first rack having at one end a hingedly connected middle piece, and at an opposite end a hingedly connected lever, said lever being fastened to the chassis and having a free end pivotably connected to said supporting piece, first stepper motor means for providing a zigzag motion to the machine needle, said motor means having a drive shaft which reciprocates said rack to impart zigzag motion to said needle, means for causing variations in the reciprocating motion of the rack so as to change the zigzag motion of the needle, a feeding device, an eccentric linked to a shaft which is powered by the main motor, a second rack piece which through a middle piece is pivotably linked to a connecting rod, said connecting rod having an upper end biased against said eccentric by a spring, and a lower end connected to an axle which in turn is connected to the feeding device of the machine, and second stepping motor means for imparting a shifting movement to said second rack piece, said motor means having a second drive shaft which is connected to said connecting rod, thereby providing forward and backward shifting motion to said feeding device.

2. The sewing machine of claim 1, further comprising a middle piece having a shaft for connecting said second rack piece to said second drive shaft.

3. The sewing machine of claim 2, wherein the oscillating motion of said connecting rod takes place in the area around said shaft of said middle piece.

* * * * *